US008302225B1

(12) United States Patent
Earnest

(10) Patent No.: US 8,302,225 B1
(45) Date of Patent: Nov. 6, 2012

(54) SWADDLE GARMENT

(76) Inventor: Tamara Walker Earnest, Estero, FL (US)

( * ) Notice: Subject to any disclaimer, the term of this patent is extended or adjusted under 35 U.S.C. 154(b) by 68 days.

(21) Appl. No.: 12/824,920

(22) Filed: Jun. 28, 2010

Related U.S. Application Data

(62) Division of application No. 12/772,978, filed on May 3, 2010, now abandoned, and a division of application No. 12/773,821, filed on May 4, 2010, now Pat. No. 7,954,187.

(60) Provisional application No. 61/221,059, filed on Jun. 28, 2009.

(51) Int. Cl.
*A47G 9/08* (2006.01)

(52) U.S. Cl. ..... 5/494; 5/655; 5/413 R

(58) Field of Classification Search ..... 5/494, 413 R, 5/655, 482; 2/69.5, 69
See application file for complete search history.

(56) References Cited

U.S. PATENT DOCUMENTS

| | | | | |
|---|---|---|---|---|
| 4,680,030 | A * | 7/1987 | Coates et al. | 604/391 |
| 4,979,250 | A | 12/1990 | Troncone | |
| 5,129,406 | A | 7/1992 | Magnusen | |
| 6,009,576 | A * | 1/2000 | Gramme et al. | 5/413 R |
| 6,393,612 | B1 | 5/2002 | Thach | |
| 6,868,566 | B2 | 3/2005 | Gatten | |
| 6,928,674 | B2 * | 8/2005 | Blackburn | 5/482 |
| 7,043,783 | B2 | 5/2006 | Gatten | |
| 7,181,789 | B2 * | 2/2007 | Gatten | 5/494 |
| 7,246,392 | B2 * | 7/2007 | Schmid et al. | 5/655 |
| 7,587,769 | B1 * | 9/2009 | McDermott | 5/494 |
| 2004/0158925 | A1 * | 8/2004 | Sims | 5/494 |
| 2004/0216230 | A1 * | 11/2004 | Blackburn | 5/482 |
| 2006/0010600 | A1 * | 1/2006 | Kendy | 5/482 |
| 2007/0056098 | A1 * | 3/2007 | Schmid et al. | 5/482 |
| 2009/0249526 | A1 * | 10/2009 | Carangelo | 2/69.5 |
| 2010/0071709 | A1 * | 3/2010 | Grissom | 5/494 |

OTHER PUBLICATIONS

Swaddle Sleeve, Original Swaddle Sleeve in Pink Fleece with Brown Trim, Etsy.com, Apr. 2, 2009, USA.

* cited by examiner

*Primary Examiner* — Robert G Santos
*Assistant Examiner* — Brittany Wilson
(74) *Attorney, Agent, or Firm* — William E. Noonan

(57) ABSTRACT

A swaddle garment to calm and comfort an infant has two panels and a leg pouch. One panel that is both wide and long enough to wrap entirely both of the infant's arms and a second panel to then wrap around the infant's torso and secured arms. The bottom portions of the back and front panels form a leg pouch to contain the infant's legs. Hook and loop fasteners are used to secure the arm restraints, and the bottom of the leg pouch has an opening for easy access for diaper changes.

17 Claims, 9 Drawing Sheets

SWADDLE GARMENT

RELATED APPLICATIONS

The present application claims the benefit of U.S. provisional patent application Ser. No. 61/221,059, filed Jun. 28, 2009, for SWADDLE ACCESSORY AND SWADDLE FOR INFANTS, by Tamara Walker Earnest, the description of which is incorporated by reference herein.

The present application is a divisional application of U.S. patent application Ser. No. 12/772,978, filed May 3, 2010 now abandoned, for SWADDLE WRAP, by Tamara Walker Earnest.

The present application is a divisional application of U.S. patent application Ser. No. 12/773,821, filed May 4, 2010 now U.S. Pat. No. 7,954,187, for SWADDLE ACCESSORY, by Tamara Walker Earnest.

FIELD OF THE INVENTION

The present invention relates to garments for infants and, more particularly, swaddling blankets.

BACKGROUND OF THE INVENTION

Swaddling of infants has been practiced for thousands of years. Swaddling is the wrapping or binding of an infant.

The following prior art reference disclose various types of swaddling garments that have been developed to date:

U.S. Pat. No. 5,129,406, issued Jul. 14, 1992 for Method For Using an Infant Garment With Crossed Over Arm Positioning Sleeves, by Debbie A. Magnusen, David A. Magnusen;

U.S. Pat. No. 6,393,612 B1, issued May 28, 2002, for Garment, by Bradley T. Thach, Claudia M. Gerard;

U.S. Pat. No. 6,868,566 B2, issued Mar. 22, 2005, for Swaddling Blanket, by Michael Dean Gatten;

U.S. Pat. No. 7,043,783 B2, issued May 16, 2006, for Swaddling Blanket, by Michael Dean Gatten;

U.S. Pat. No. 7,181,789 B2, issued Feb. 27, 2007, for Swaddling Blanket, by Michael Dean Gatten;

U.S. Pat. No. 7,246,392 B2, issued Jul. 24, 2007, for Wearable Blanket and a Swaddling Accessory Therefor, by William R. Schmid, Dawn Griffin; and U.S. Pat. No. 7,587,769 B1, issued Sep. 15, 2009, for Swaddling Article, by Julie McDermott.

Swaddling provides many benefits. Newborns can have trouble regulating their body temperature. Swaddling keeps an infant warm and allows a caregiver to handle and carry an infant more easily. It is believed that swaddling comforts the infant and allows them to sleep more soundly. The snugness of the swaddle may remind them of the confinement of the womb and provides comfort and a sense of security. Swaddling with the arms bound also helps prevents an infant from waking due to their startle reflex. Pressure across the abdominal and chest area has a calming effect and is thought to relieve colic. Swaddling has been used more recently in the calming of older children that may have special needs.

The suggested positioning for an infant to sleep to reduce the risk of SIDS is on their back. Some infants do not tolerate sleeping on their back well unless they are swaddled.

The preferred method of swaddling is to keep the infant's arms at their sides while providing even, gentle pressure across the chest and abdominal area. However, infants rarely keep their arms at their sides and are able to break out of traditional swaddles. Due to startle reflexes, they startle themselves awake. A snug swaddle can make an infant less restless. Also, once they get their arms up by their chest or mouth, their rooting reflex kicks in and can interrupt their sleep. Older children are much stronger and can break out of a swaddle easily.

Another problem with not being able to keep the infant's arms at their sides is that they can work loose a blanket or swaddle device and it may migrate over their face causing a risk of suffocation, or strangulation. Also, swaddling can pose a risk to an infant if they are wrapped too tight to inhibit normal breathing. Immobilization of the legs may promote hip dysplasia.

Although most infants are only swaddled for 3-4 months, some require swaddling well past that age to sleep more soundly. A swaddle that comes loose may make an infant restless and interrupt their sleep. Some infants don't like having their legs contained and will become restless attempting to kick out of the swaddle. Having their legs uncovered could allow them to become cold and unable to sleep soundly. Older babies are stronger and are much harder to keep from breaking out of their swaddle.

Infants in a hospital setting sometimes need their arms immobilized to prevent them from inadvertently pulling out tubes, IV's or disconnecting other medical monitoring devices.

Overheating is also a risk related to swaddling. Overheating can contribute to an increased risk of SIDS.

Diaper changes usually require the infant to be un-swaddled and then re-swaddled, unnecessarily awakening the infant.

An ideal execution of swaddling would provide a way to keep the infant's arms fixed at their sides, provide gentle even pressure across the chest and abdominal area, reduce the risk of overheating, provide easy access for diaper changes and provide a leg pouch that the infant is unable to kick out of.

There are several patented swaddling devices referenced in the related applications portion of this application that have built-in arm restraints to attempt to keep the infant from breaking out of his swaddle.

The shortcomings of the prior art are either one of or a combination of the following:

- They do not properly contain an infant's arms. The arm restraints are lacking in function. Either they are a preformed sleeve or pocket that is extremely difficult to insert an infant's arm through, or they are lacking any fasteners (such as hook and loop) to keep the arm restraint in place and inescapable for a wiggly infant, or they fail to keep the infant's arms in the preferred position, at their sides.
- They do not provide easy access for diaper changes. Having to unswaddle an infant in the middle of the night to change a soiled diaper can unnecessarily awaken a sleeping infant.
- They can be cumbersome or must be wrapped around the infant too many times. Wrapping the infant several times puts them at risk for overheating. Overheating can contribute to an increased risk of SIDS.
- If bound too tight in order to attempt to keep the infant from breaking free, a swaddle can inhibit chest wall movement, compromising an infant's ability to breathe normally.
- If the swaddle binds the infant's legs preventing them from flexing and abducting normally, this may lead to the development of hip dysplasia.
- The swaddle isn't secured with fasteners (such as hook and loop) making it easy for an infant to break loose putting the infant at risk for strangulation or suffocation.

Infants are able to kick their way out of the leg pouch. The present invention remedies the defects of known swaddles by providing an easy to use swaddle that keeps the infant's arms secured in the preferred position, at their sides, provides even gentle pressure across the chest and abdominal area, allows easy access for diaper changes, only wraps the infant once to reduce the risk of overheating, allows free movement of the legs to reduce the risk of developing hip dysplasia, has fasteners to keep the swaddle from coming loose, and is fashioned in such a way that the infant is unable to kick out of the leg pouch.

SUMMARY OF THE INVENTION

A preferred embodiment of the present invention has two panels that can be made from fabric or material. The back panel is both wide and long enough to wrap both of the infant's arms, entirely, in the preferred position, at their sides. There is a piece of hook at each end of the back panel that attaches to loop in the center and on the back side of the back panel at the infant's back. There is loop at one end of the back panel for overlap when wrapping the arms of smaller infants. There is an extension of fabric or material on the back panel that is for the back portion of a leg pouch.

The front panel is both wide and long enough to wrap around the infant's torso and secured arms. There is a panel of loop fabric on the front and towards one end of the front panel. A piece of hook that is at the opposite end of the front panel attaches to the panel of loop fabric once it is wrapped around the infants torso and secured arms. There is an extension of fabric or material on the front panel that is for the front portion of the leg pouch.

Strips of loop are adjacent to all strips of hook to act as laundry tabs to protect other garments when laundered together. The side edges of the back panel extension are attached to the side edges of the front panel extension to form a leg pouch. At the bottom of the pouch there is a casing with elastic to partially close the leg pouch. Another embodiment of the present invention has a zipper connecting the bottom edges of the leg pouch to form a closed pouch.

To swaddle an infant using the present invention, the back panel is laid with the loop at the center and on the back side down. The infant is placed with his back where the loop is located on the opposite side of the back panel and with his armpits even with the top edge of the panel and his legs placed inside the leg pouch. The arm adjacent to the end of the back panel that has the loop for overlap is wrapped first by raising the infant's arm and bringing up the end of the back panel between the arm and chest. The arm is brought down to his side and the end of the back panel is wrapped around the outside of the arm and the hook is attached to the loop at his back. The other arm is wrapped the same way. The front panel is laid across the infant with the top edge even with the infant's armpits and then wrapped around the torso and secured arms. The hook at one end of the front panel is attached to the panel of loop fabric on the front panel. Both arms are restrained in the preferred position, at his sides, the infant is securely swaddled and is unable to kick out of the leg pouch.

The present invention allows the infant's arms to be restrained and his torso swaddled without being able to break out and wake himself. Gentle, even pressure is provided across the chest and abdominal area. The risk of overheating is reduced. Easy access for diaper changes is provided. The infant's legs are contained inside the leg pouch and he is unable to kick his legs out. The infant is kept warm and securely swaddled.

Some benefits of the present invention may be obtained with a simplified embodiment consisting of a leg pouch that is permanently closed at the bottom.

It would be advantageous to provide hook and loop at the ends of the back panel with loop in the center at the infant's back and provide hook and loop for use in securing the front panel around the infant's torso and secured arms. It would also be advantageous to provide additional loop at the ends of the panel as laundry tabs. When washing the swaddle, the hook and loop laundry tabs are attached to protect other items in the washer from being snagged by the hook.

It would further be advantageous to provide easy access for diaper changes by leaving the bottom of the leg pouch open or closing it with a zipper, hook and loop or other means, or using elastic, ribbon, string or other means for a partially closed pouch.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
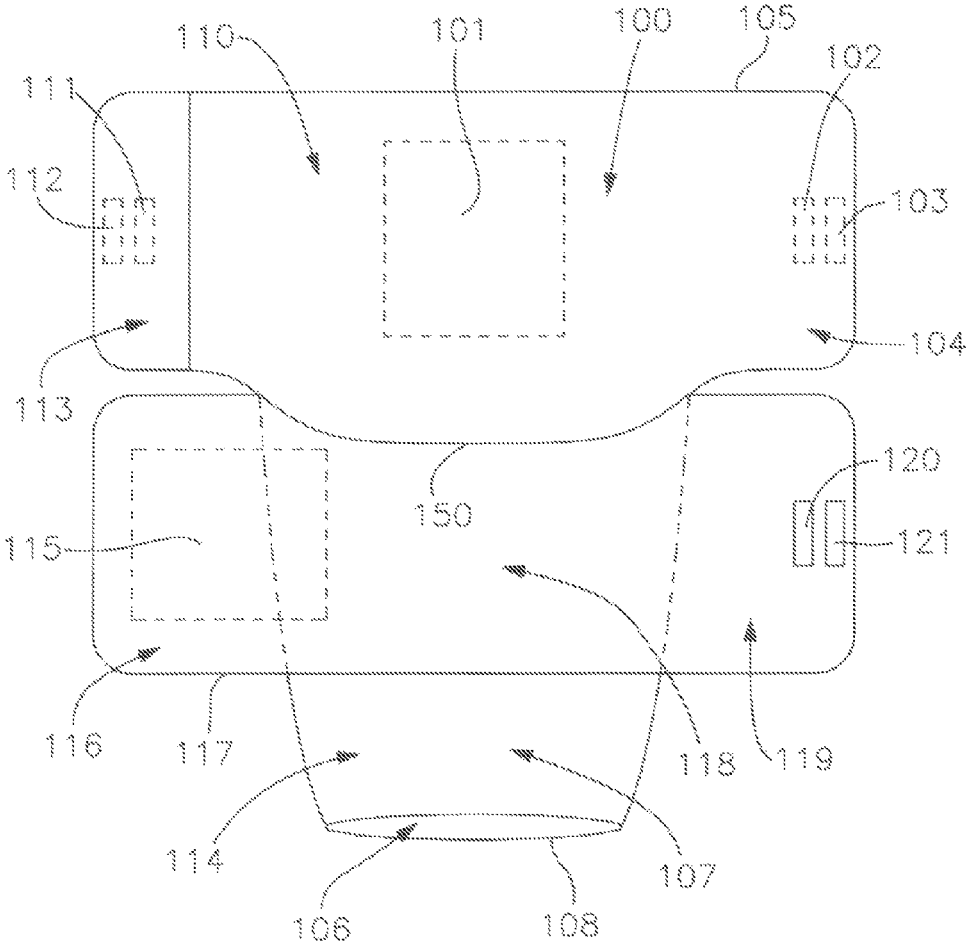
FIG. 1 is a view of the preferred embodiment of the present invention.

FIG. 1 shows a preferred embodiment of the present invention having a back panel 100, a back loop panel 101, a first arm restraint 110, a strip of hook on the first arm restraint 112, a strip of loop on the first arm restraint 111, loop piece 113 for overlap a second arm restraint 104, a strip of hook on the second arm restraint 103, a strip of loop on the second arm restraint 102, a front panel 118, a first wrap end 116, a front loop panel 115, a second wrap end 119, a strip of hook 121 on the second wrap end, a strip of loop 120 on the second wrap end, and a leg pouch 114 comprising a back portion 106, and a front portion 107.

Figure 5:
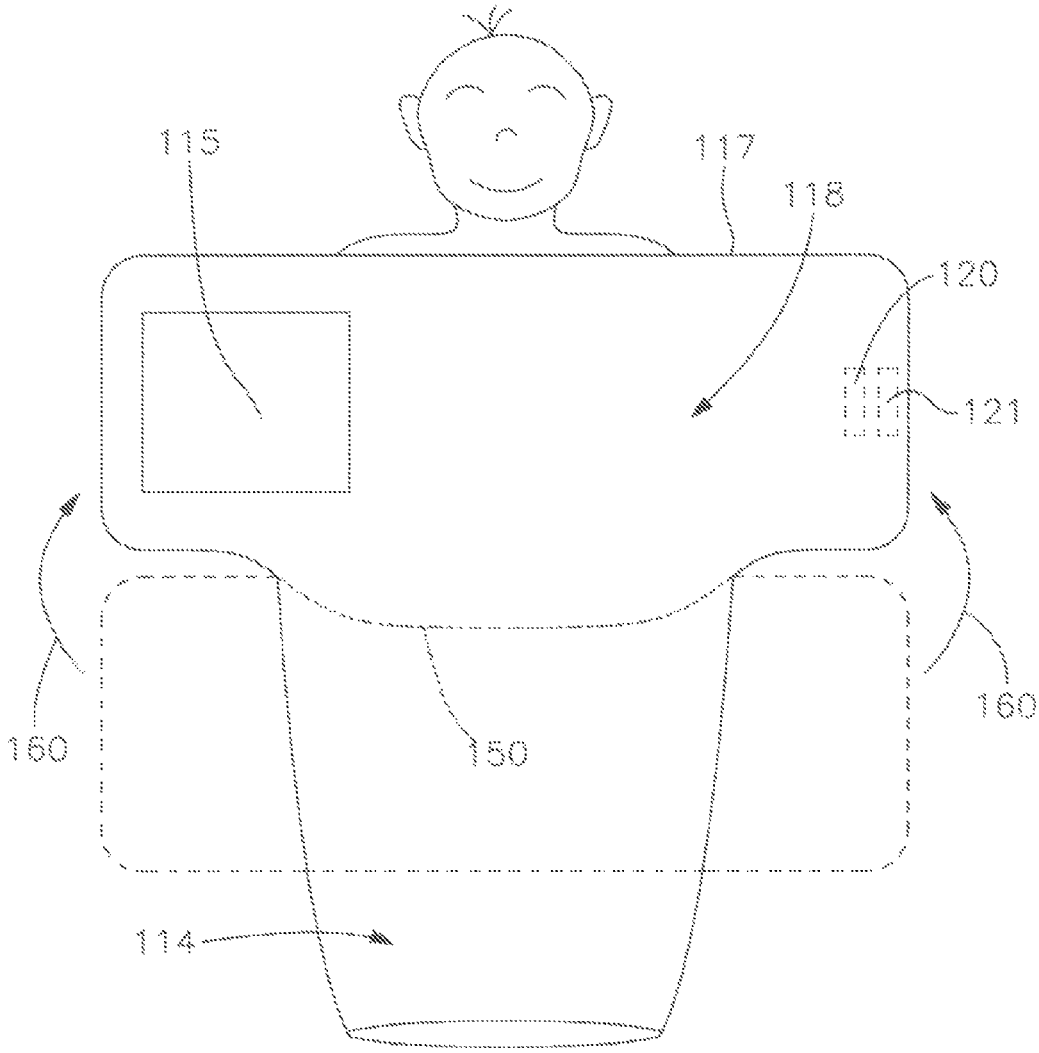
FIG. 5 is a view of the embodiment of FIG. 1 with both of the infant's arms secured by the back panel and the front panel placed across the infant's torso.

In this embodiment, the back panel 100 is long enough to cover the infant's arms from shoulder to beyond the fingertips and wide enough to wrap both of the infant's arms. Front panel 118 is foldably attached along an upper edge 150 of front leg pouch portion 107. The front panel folds upwardly and downwardly as shown in FIG. 5 and as described below. The front panel 118 (shown folded downwardly in FIG. 1) is long enough when folded upwardly (FIG. 5) to cover the infant's torso from the shoulders to beyond the fingertips and wide enough to wrap the infant's torso and secured arms. The back portion of leg pouch 106 is long enough to cover the infant's legs and feet. The front portion 107 of leg pouch 114 is long enough to cover the infant's legs and feet. The back panel 100, front panel 118, back portion 106 and front portion 107 can also be made long enough and wide enough to secure the arms and swaddle older and larger children or a person of any size. Front and back portions 106, 107 are attached to each other along opposite vertical sides thereof.

The parts of the present invention are made from sheet material, usually fabric and hook and loop fasteners and leg pouch 114 closures that include, but are not limited to an elastic casing, zipper, hook and loop or any other closure. Many fabrics known in the art may be used depending on the desired characteristics such as elasticity, warmth, weight, breathability, stain resistance, absence of allergens, visual appeal and other factors. The present invention may be made of a single material or parts may be made of different materials. Flexible, non-fabric materials may also be used to provide special characteristics.

Figure 3:
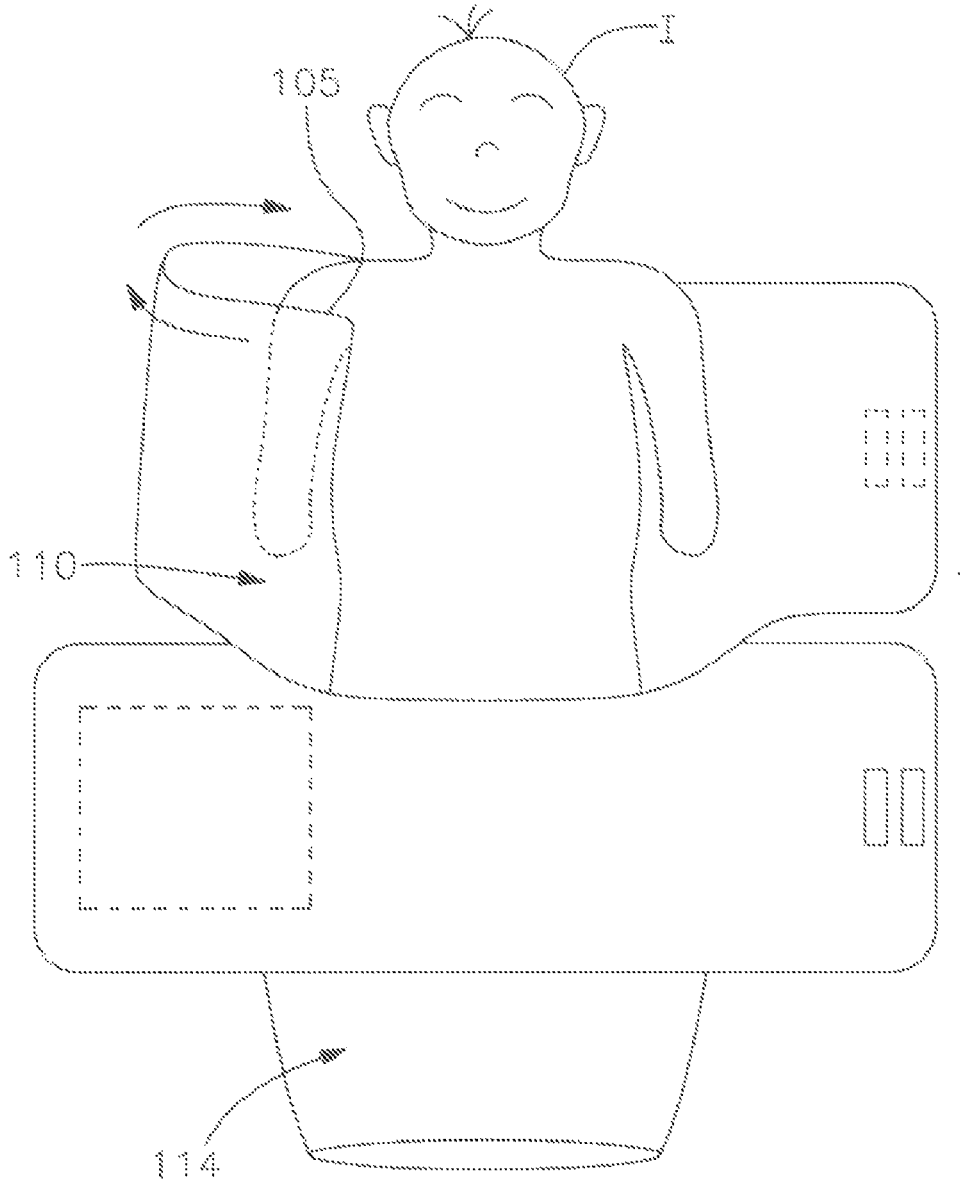
FIG. 3 is a view of the embodiment of FIG. 1 with the first arm restraint wrapped around the infant's right arm and attached to the loop at the infant's back.
Figure 4:
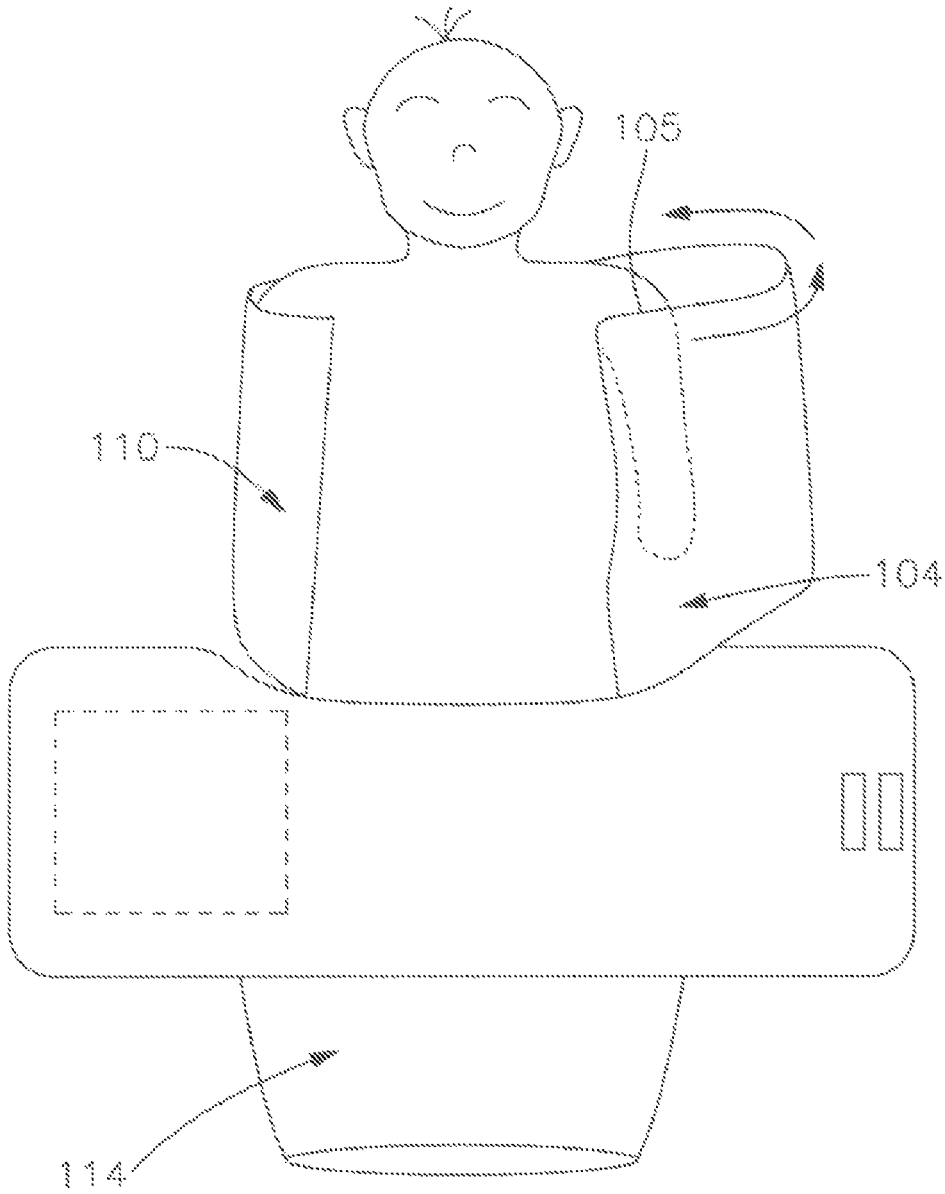
FIG. 4 is a view of the embodiment of FIG. 1 with both of the infant's arms secured by the back panel.

The first arm restraint 110 extends from the back panel 100 and is long enough to wrap once, as shown in FIG. 3, from between the infant's first arm and chest and outwardly over the infant's arm with the end attaching to the back loop panel 101 (FIG. 1) on the back side of the back panel 100 by means of a strip of hook 112 on the first arm restraint. The second arm restraint 104 extends from the back panel 100 and is long enough to wrap once, as shown in FIG. 4, from between the infant's second arm and chest and outwardly over the infant's arm with the end attaching to either the back loop panel 101 or the loop piece 113, by means of a strip of hook 103 on the second arm restraint 104.

The first arm restraint 110, the second arm restraint 104 and the back portion 106 of leg pouch 114 may be separate pieces sewn or attached to back panel 100 by other means known in the art. Alternatively, the first arm restraint 110, the second arm restraint 104, the back portion 106 of leg pouch 114 and the back panel 100 may be of a single, continuous piece of material.

The first wrap end 116, the second wrap end 119 and the front portion 107 of leg pouch 114 may be separate pieces sewn or attached by other means known in the art to the front panel 118, or the first wrap end 116, the second wrap end 119, the front portion 107 and the front panel 118 may be of a single, continuous piece of material.

As shown in FIG. 1, at the end and on the back side of the first arm restraint 110 there is a strip of hook 112 that attaches to the back loop panel 101 on the back side of the back panel 100. Adjacent to the strip of hook 112, there is a strip of loop 111 on the first arm restraint 110 that can be attached to the strip of hook 112 to act as a laundry tab to protect other items being laundered at the same time.

At the end and on the back side of the second arm restraint 104 there is a strip of hook 103 that attaches to the loop panel 101 on the back side of the back panel 100. Adjacent to the strip of hook 103 on the second arm restraint 104, there is a strip of loop 102 than can be attached to the strip of hook 103 to act as a laundry tab to protect other items being laundered at the same time.

At the center and on the back side of the back panel 100 there is a loop panel 101 that is used to secure the first arm restraint 110 and the second arm restraint 104. Many other fabrics or materials may be used instead or in addition to perform as loop to secure the first arm restraint 110 and the second arm restraint 104. The loop panel is long and wide enough allow the first arm restraint 110 and the second arm restraint 104 to secure the arms of various sized infants, older children or a person of any size.

On the front side and at the end of the first arm restraint 110, there is loop 113 for overlap of the second arm restraint 104. In the case of a smaller infant, the first arm restraint 110 when wrapped around the infant's first arm and attached to the loop panel 101 at the back panel 100, may have such excess that it uses the entire loop panel. The loop 113 provides a place for the strip of hook 103 on the overlapping second arm restraint 104 to attach to when the infant's second arm is wrapped. Many other fabrics or materials may be used instead or in addition to perform as loop to provide a place for the overlapping of the second arm restraint 104 to attach to. The position of the loop overlap may be reversed in any embodiment of the present invention without impairing the utility of the invention.

At one end of the front panel 118 is the first wrap end 116. When the front panel 118 is unfolded upwardly along edge 150, as shown by arrows 160 in FIG. 5, and placed on the infant's torso, the first wrap end 116 is wrapped around the infant's torso and first secured arm to the infant's back. The first wrap end 116 is at least long enough to reach to the infant's back once wrapped around the infant's torso and first secured arm. The first wrap end 116 may be of any length in any embodiment of the present invention without impairing the utility of the invention. At the opposite end of the front panel 118 is the second wrap end 119. After the first wrap end 116 is wrapped around the torso and secured (right) first arm of the infant, the second wrap end 119 is wrapped around the torso and secured second (left) arm of the infant.

Near the end and on the back side of the first wrap end 116 there is a front loop panel 115 that is used to secure the second wrap end 119 to the first wrap end 116 after wrapping the infant's torso and secured arms. Many other fabrics or materials may be used instead or in addition to perform as loop to secure the second wrap end 119 to the first wrap end 116. The front loop panel 115 is long and wide enough to allow the front panel 118 to swaddle the torso and secured arms of various sized infants, older children or a person of any size. The position of the front loop panel 115 may be reversed in any embodiment of the present invention without impairing the utility of the invention.

At the end and on the front side of the second wrap end 119 there is a strip 121 of hook on the second wrap end 119 that attaches to the front loop panel 115 on the back side of the front panel 118. Adjacent to the strip of hook 121, there is a strip of loop 120 on the second wrap end 119 that can be attached to the strip of hook 121 to act as a laundry tab to protect other items being laundered at the same time. The position of the strip of hook 121 and the strip of loop 120 may be reversed in any embodiment of the present invention without impairing the utility of the invention.

On the back side of the front panel 118 there is a front loop panel 115. Once the first wrap end 116 has been wrapped around the infant's torso and first secured arm, the second wrap end 119 is wrapped around the infant's torso and second secured arm and attached to the front loop panel 115 to secure the swaddle. See FIG. 6. Many other fabrics or materials may be used instead or in addition to perform as loop to provide a place for the second wrap end 119 to attach to.

The vertical sides of the back portion 106 of leg pouch 104 are attached to the sides of the front portion 107 of leg pouch 114 to form the leg pouch to contain the infant's legs and feet.

In this embodiment of the present invention the bottom edge 108 of leg pouch 114, FIG. 1, is left open to provide easy access for diaper changes. The bottom edge 108 of the leg pouch can be partially closed by using elastic, ribbon, string or other materials known to the art for a leg pouch closure 109. The bottom edge 108 can also be left completely open without impairing the utility of the invention.

Figure 8:
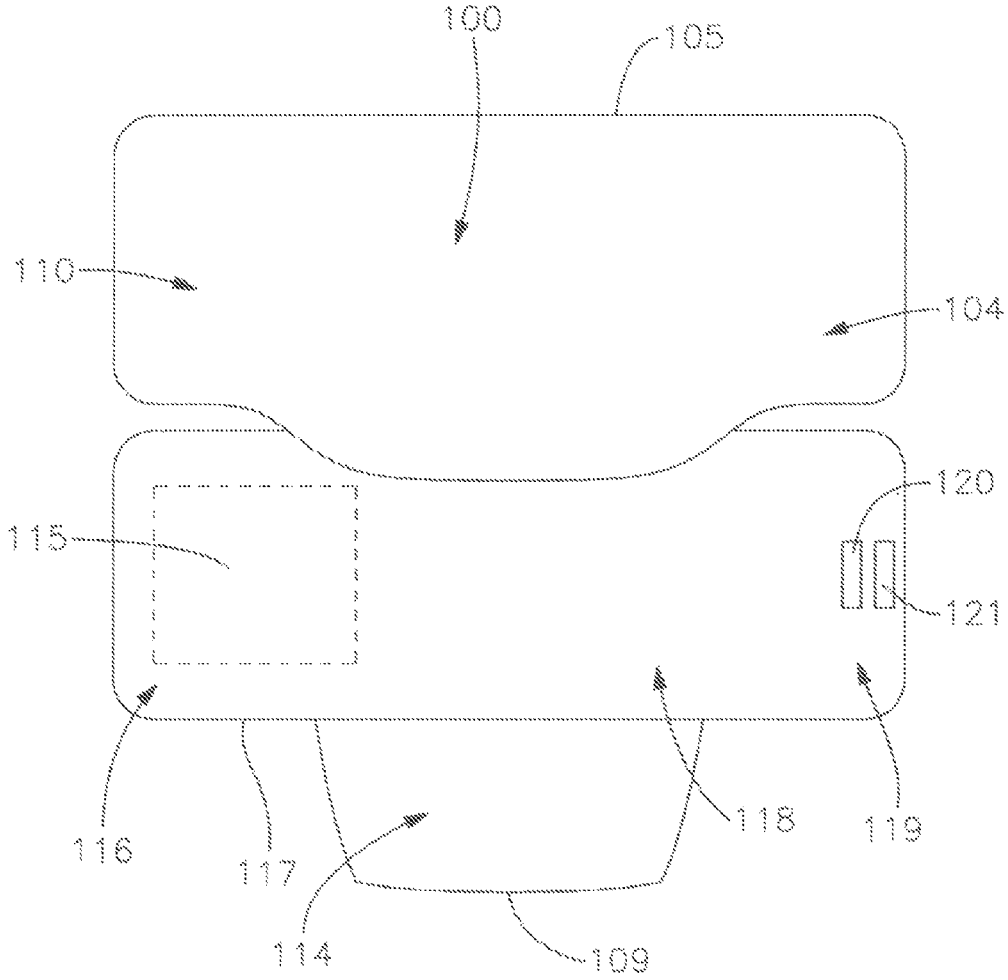
FIG. 8 is a view of an alternate embodiment of the present invention without hook and loop fasteners to secure the arms.

It should be noted that some of the benefits of the present invention may be obtained with a simplified version, as shown in FIG. 8, consisting only of the back panel 100, the first arm restraint 110, the second arm restraint 104, and the front panel 118, with the bottom edges of the back portion 106 and front portion of leg pouch 114 sewn together to make a leg pouch 114 to completely contain the infant's legs and feet. However, the addition of the strip of hook 112 on the first arm restraint 110, the strip of hook 103 on the second arm restraint 104, the back loop panel 101 at the back of the back panel 100, the front loop panel 115, and the strip of hook 121 on the second wrap end 119, as previously described, allows a caregiver or parent to secure both the infant's arms, and the overlapping front panel 118 so that the secured child is unable to break out of the swaddle. The addition of the opening at the bottom of the leg pouch 114 allows access for easy diaper changes without having to unswaddle and reswaddle the infant.

It should also be noted that a leg pouch closure 109 for the bottom of the leg pouch 114 can be made with a zipper, hook and loop or other materials known to the art.

Figure 2:
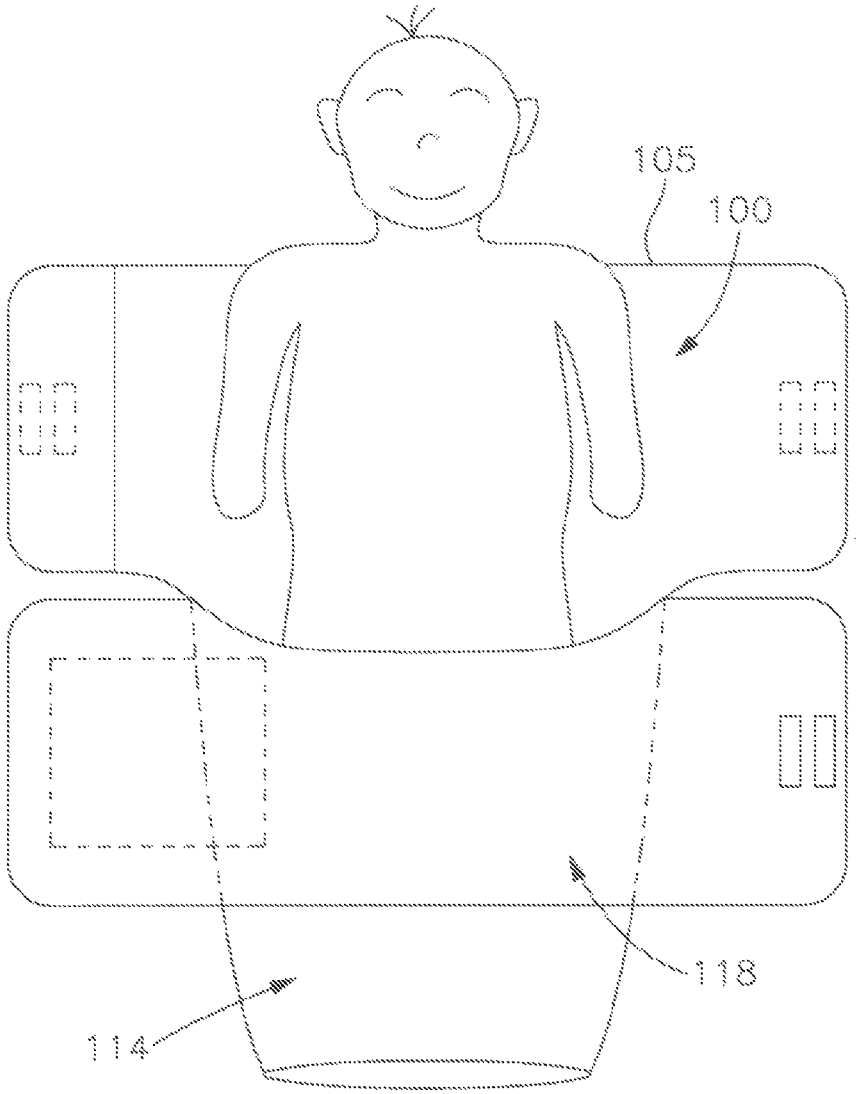
FIG. 2 is a view of the embodiment of FIG. 1 as it would look with the infant placed on the back panel and the legs contained inside the pouch.

FIG. 2 shows the position of the infant when placed on the preferred embodiment of the present invention. The infant is placed such that his armpits are even with the top edge of back panel 105 with the back loop panel 101 (not visible in FIG. 2, but see FIG. 1) at his back, with his arms along his sides and his legs contained in the leg pouch 114.

Figure 6:
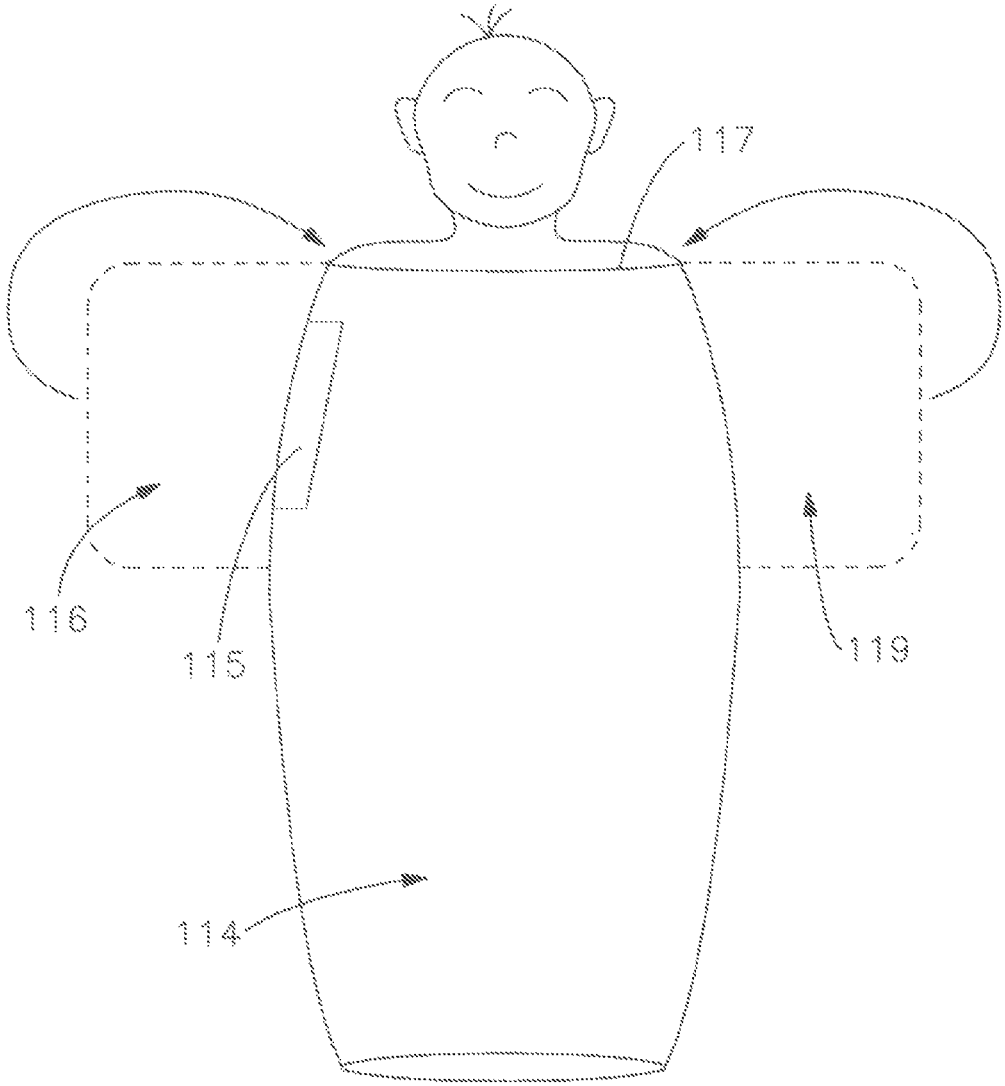
FIG. 6 is a view of the embodiment of FIG. 1 with both of the infant's arms secured by the back panel and swaddled by front panel.
Figure 9:
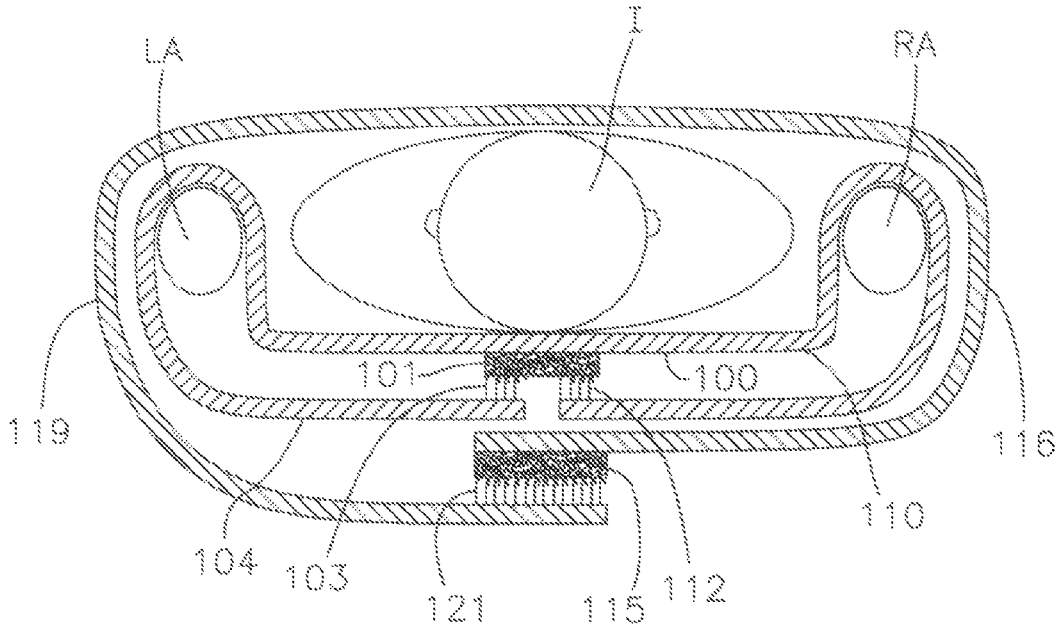
FIG. 9 is a simplified, cross sectional view of the swaddling garment wrapped about and swaddling an infant.

FIGS. 3, 6 and 9 illustrate a preferred method for employing the preferred embodiment of the present invention.

FIG. 3 shows an infant I lying on the back panel 100 with his armpits aligned with the top edge of back panel 105, his arms along his sides, and his legs contained by the leg pouch 114. The child's first (right) arm RA, FIG. 9, is secured by wrapping the first arm restraint 110 around the first arm by bringing the first arm restraint 110 up between the chest and arm and wrapping the first arm restraint 110 outwardly over and around the arm and behind the infant's back. The strip of hook 112 on the first arm restraint 110 is releasably fastened to the back loop panel 101 (not visible in FIG. 3) on the back side of the back panel 100.

FIG. 4 shows the infant lying on the back panel with his armpits aligned with the top edge 105 of panel, his arms along his sides, his legs contained by the leg pouch 114, and his first arm secured by arm restraint 110. The infant's second arm is secured by wrapping the second arm restraint 104 around the second arm in an analogous manner, i.e. by bringing the second (left) arm restraint 104 up between his chest and second, left arm LA and wrapping the second arm restraint 104 outwardly over and around the second arm. The strip of hook 103 on the second arm restraint 104 is attached either to the loop panel 101 on the back side of the back panel 100 (See FIG. 9) or to the loop 113 carried by the front surface of arm restraint 110, depending on the size of the infant or child. Both arms are now secured.

FIG. 5 shows the position of the front panel 118 unfolded upwardly and placed across the infant's torso with the top edge of front panel 117 even with the infant's armpits. After the child's arms are restrained and secured as previously described, front panel 118 is alternated from the folded, lowered condition shown in FIGS. 1-4 to the unfolded, raised condition shown in FIG. 5. The end wraps are then wrapped around the infant's torso over the wrapped and secured arm restraints.

FIG. 6 specifically shows the infant with both arms restrained in the previously disclosed manner and illustrates how the infant's torso and secured arms are swaddled by wrapping the first wrap end 116 (shown in phantom) around to the infant's back and then wrapping the second wrap end 119 (likewise shown in phantom) around to the infant's back. The strip of hook 121 (FIG. 1) on the second wrap end 119 is attached to the front loop panel 115 on the first wrap end 116. Swaddling is thereby completed. See also FIG. 9.

Figure 7:
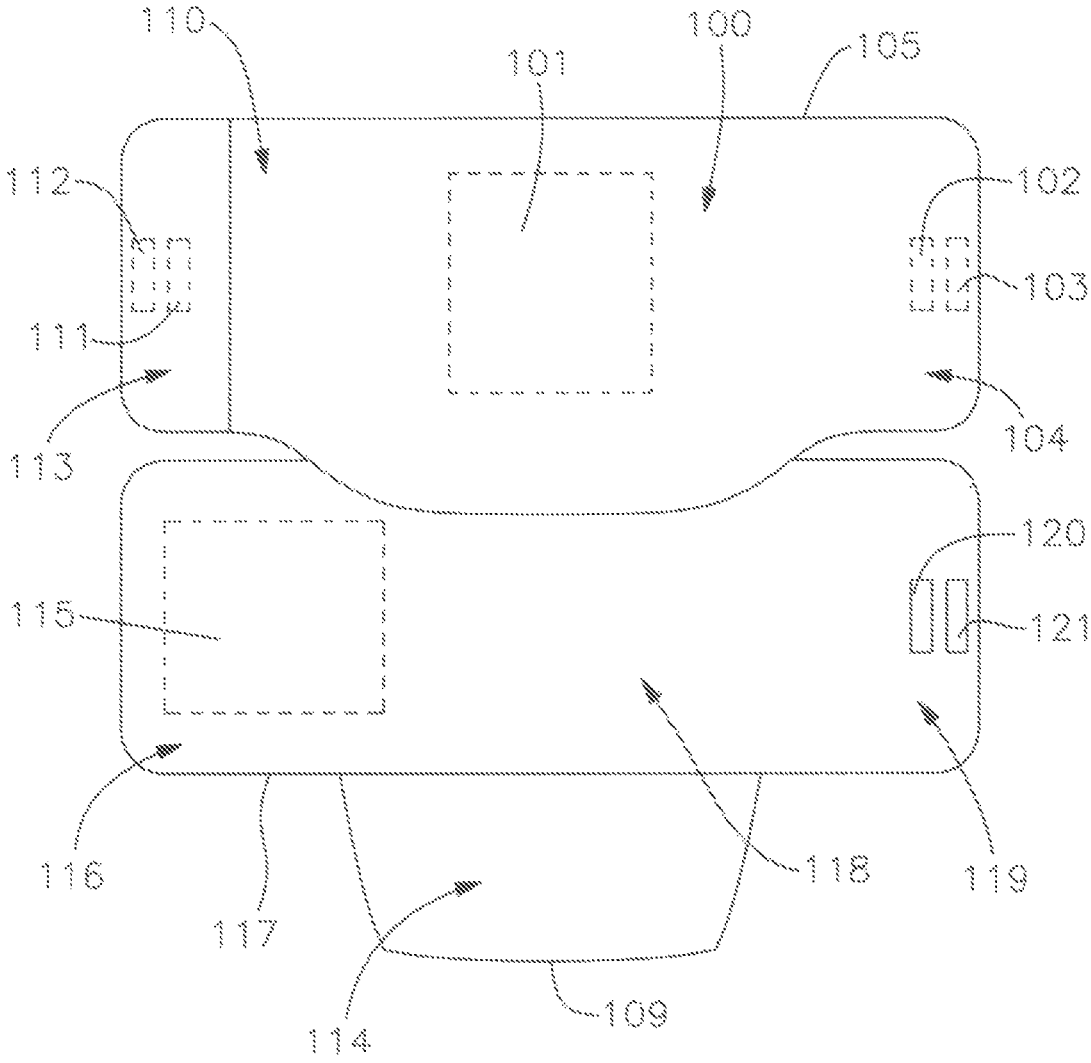
FIG. 7 is a view of an alternate embodiment of the present invention with the bottom of the leg pouch closed by a zipper or other means.

FIG. 7 shows an alternate embodiment of the present invention with the bottom edge of leg pouch 108 completely closed by use of a leg pouch closure 109 such as a zipper, hook and loop or any other material known to the art.

FIG. 8 shows a simplified embodiment of the present invention without hook and loop fasteners for securing the first arm restraint 110 and the second arm restraint 104.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A garment for swaddling a person, said garment comprising:

a back panel for engaging the person's back;

first and second arm restraints attached to and extending outwardly in opposing directions from said back panel;

said first and second arm restraints being wrappable about respective arms of the person, and said back panel and each said arm restraint carrying respective first releasable closure components, which are selectively and releasably interengaged to releasably fasten said respective arm restraints to said back panel;

a leg pouch including a back portion attached and depending from said back panel and a front portion attached to said back portion along respective sides of said leg pouch, said leg pouch for receiving the legs of the person; and an elongate front panel attached foldably to an upper end of said front portion of said leg pouch, said front panel being folded downwardly relative to said leg pouch to extend across said front portion of said leg pouch and being unfolded upwardly for extending across the torso of the person, said front panel having first and second end wraps formed at respective ends of said front panel;

said front panel being unfolded upwardly and said first and second end wraps being wrappable over said back panel with said first and second arm restraints fastened to said back panel and said first and second end wraps carrying respective second releasable closure components, which are selectively interengaged to releasably secure said first end wrap to said second end wrap over said first and second arm restraints; whereby the person is swaddled by the garment.

2. The garment of claim 1 in which each of said back panel, said first and second arm restraints, said leg pouch, said front panel and said first and second end wraps comprises a flexible sheet material.

3. The garment of claim 1 in which one of said first closure components includes a hook fastener and the other first closure component includes a loop fastener that is releasably interengageable with said hook fastener.

4. The garment of claim 1 in which said back panel includes a front surface for facing and engaging the back of the person and in which one of said first closure components is carried by a back surface of said back panel and the other of said first closure components is carried by a back surface of said arm restraint.

5. The garment of claim 4 in which said first closure components carried by said arm restraints include respective hook fasteners and said first closure component carried by said back panel includes a loop fastener, each said arm restraint further carrying a laundry tab loop fastener on a back surface of said arm restraint, which laundry tab loop fastener is releasably attachable to said hook fastener carried by said arm restraint.

6. The garment of claim 1 in which one of said second closure components includes a hook fastener and the other of said second closure components includes a loop fastener that is releasably interengageable with said hook panel to releasably fasten said first end wrap directly to said second end wrap.

7. The garment of claim 1 in which each said arm restraint is for extending between a respective arm and the chest of the person, said arm restraint being wrappable about the respective arm and engageable with a back surface of said back panel for interengaging said respective first closure components and fastening said arm restraint to said back panel to secure the respective arm of the person infant, said front panel for being unfolded to wrap said end wraps about the person's torso and secured arms and over said first and second arm restraints fastened to said back panel, said second closure components being interengaged to fasten said end wraps together.

8. The garment of claim 1 in which said second closure components are respectively carried on oppositely facing surfaces of said front panel.

9. The garment of claim 6 further including a front panel laundry tab loop fastener carried by said front panel proximate said hook fastener, said front panel laundry tab loop fastener being releasably attachable to said front panel hook fastener.

10. The garment of claim 4 in which one of said first closure components includes a hook fastener, each said arm restraint carrying a respective hook fastener, and wherein the other said first closure component includes a single loop fastener panel carried by said back panel and releasably interengageable by each of said hook fasteners.

11. The garment of claim 1 in which said leg pouch includes a lower opening formed between lower ends of said front and back portions of said leg pouch.

12. The garment of claim 1 further including an adjustable leg pouch closure for selectively expanding and narrowing said lower opening of said leg pouch.

13. A garment for swaddling a person, said garment comprising:

a back panel for engaging the person's back;

first and second arm restraints attached to and extending outwardly in opposing directions from said back panel; said first and second arm restraints being wrappable about respective arms of the person and having distal ends for engaging said back panel;

a leg pouch including a back portion attached and depending from said back panel and a front portion attached to said back portion along respective vertical sides of said pouch, said leg pouch for receiving the legs of the person;

an elongate front panel attached foldably to an upper end of said front portion of said leg pouch, said front panel being folded downwardly relative to said leg pouch to extend across said front portion of said leg pouch and being unfolded upwardly for extending across the torso of the person, said front panel having first and second end wraps formed at respective ends of said front panel;

said front panel being unfolded upwardly and said first and second end wraps being wrappable about said arm restraints wrapped about the respective arms of the person and about said back panel, whereby the person is swaddled by the garment.

14. The garment of claim 13 in which each of said back panel, said first and second arm restraints, said leg pouch, said front panel and said first and second end wraps comprises a flexible sheet material.

15. The garment of claim 13 in which each arm restraint is for extending between a respective arm and the chest of the infant, said arm restraint being wrappable about the respective arm and engageable with a bottom surface of said back panel, said front panel for being unfolded to wrap said end wraps about the infant's torso and secured arms and over said first and second arm restraints engaged with said back panel.

16. The garment of claim 13 in which said leg pouch includes a lower opening formed between lower edges of said front and back portions of said leg pouch.

17. The garment of claim 13 further including an adjustable leg pouch closure for selectively expanding and narrowing said lower opening of said leg pouch.

* * * * *